US008373601B2

(12) United States Patent
Wu et al.

(10) Patent No.: US 8,373,601 B2
(45) Date of Patent: Feb. 12, 2013

(54) MULTI-BAND ANTENNA

(75) Inventors: Chao-Hsu Wu, Luzhu Township (TW); Chi-Yin Fang, Pingtung (TW)

(73) Assignee: Quanta Computer Inc., Tao Yuan Shien (TW)

( * ) Notice: Subject to any disclaimer, the term of this patent is extended or adjusted under 35 U.S.C. 154(b) by 335 days.

(21) Appl. No.: 12/939,066

(22) Filed: Nov. 3, 2010

(65) Prior Publication Data

US 2011/0316760 A1 Dec. 29, 2011

(30) Foreign Application Priority Data

Jun. 23, 2010 (TW) ..... 99120422 A

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,864,841 B2 * 3/2005 Dai et al. ..... 343/700 MS
7,161,543 B2 * 1/2007 Cheng et al. ..... 343/702
2011/0128185 A1 * 6/2011 Tsai et al. ..... 343/700 MS

* cited by examiner

*Primary Examiner* — Hoang V Nguyen
(74) *Attorney, Agent, or Firm* — Steptoe & Johnson LLP

(57) ABSTRACT

A multi-band antenna includes a connecting conductor, first and second conducting arms, and a loop conductor. The connecting conductor has a feed-in end and a connecting end. The first conducting arm is connected to the connecting end of the connecting conductor. The second connecting arm is connected to the connecting end of the connecting conductor and is substantially perpendicular to the first connecting arm. The loop conductor has first and second radiator sections, each adjacent and substantially parallel to a respective one of the first and second conducting arms. The loop conductor forms a substantially L-shaped gap with the first and second conducting arms, further has a grounding end adjacent to the feed-in end, and extends from the grounding end to the feed-in end.

12 Claims, 5 Drawing Sheets

MULTI-BAND ANTENNA

CROSS-REFERENCE TO RELATED APPLICATION

This application claims priority of Taiwanese Application No. 099120422, filed on Jun. 23, 2010.

BACKGROUND OF THE INVENTION

1. Field of the Invention

The present invention relates to a multi-band antenna, more particularly to an internal dual-band antenna for wireless local area network (WLAN) applications.

2. Description of the Related Art

Current internal antennas for WLAN applications, which are installed in notebook computers, are mostly based on a planar inverted-F antenna (PIFA) design.

Aside from the Bluetooth standard, the 802.11a/b/g standards are commonly used WLAN communication protocols. The 802.11a standard is for operation at frequencies ranging from 5.15 GHz to 5.825 GHz, whereas the 802.11b (or WiFi) and 802.11g standards are for operation at 2.4 GHz.

Since conventional antennas are not designed to be simultaneously compatible with the 802.11a/b/g communication protocols, multiple antennas are required to be disposed in a wireless device in order to ensure compatibility of the wireless device with each of the 802.11a/b/g communication protocols. Accordingly, aside from incurring higher component costs, more space is also needed in the wireless device to accommodate the antennas, thereby making it difficult to reduce the size of the wireless device so as to comply with the current trend toward miniaturization.

SUMMARY OF THE INVENTION

Therefore, an object of the present invention is to provide a planar multi-band antenna that is capable of covering two frequency bands and that has a relatively small size and simple structure.

Accordingly, a multi-band antenna of the present invention includes a connecting conductor, a first conducting arm, a second conducting arm, and a loop conductor.

The connecting conductor has a feed-in end and a connecting end that are distal from each other. The first conducting arm has one end connected to the connecting end of the connecting conductor. The second conducting arm has one end connected to the connecting end of the connecting conductor, and is substantially perpendicular to the first conducting arm. The loop conductor has a first radiator section adjacent and substantially parallel to the first conducting arm, and a second radiator section adjacent and substantially parallel to the second conducting arm. The loop conductor forms a substantially L-shaped gap with the first and second conducting arm, further has a grounding end adjacent to the feed-in end, and extends from the grounding end to the feed-in end.

Preferably, the connecting conductor includes a first radiator portion that extends from the feed-in end, and a second radiator portion that extends between the first radiator portion and the connecting end. The second radiator portion extends at an angle from one end of the first radiator portion opposite to the feed-in end toward the connecting end.

Preferably, the loop conductor further has a third radiator section, a fourth radiator section, and a fifth radiator section. The third radiator section extends from the feed-in end, and the first radiator section extends at an angle from one end of the third radiator section opposite to the feed-in end. The second radiator section extends at an angle from one end of the first radiator section opposite to the third radiator section. The fourth radiator section extends at an angle from one end of the second radiator section opposite to the first radiator section. The fifth radiator section extends between the fourth radiator section and the grounding end, and extends at an angle from one end of the fourth radiator section opposite to the second radiator section toward the grounding end.

Preferably, the first conducting arm and the first radiator section cooperate to form a first clearance therebetween. The second conducting arm and the second radiator section cooperate to form a second clearance therebetween. The L-shaped gap is constituted by the first and second clearances. The second radiator section and the fifth radiator section cooperate to form a third clearance therebetween.

Preferably, the connecting conductor, the first conducting arm and the second conducting arm cooperate to resonate in a first frequency band, and the loop conductor is configured to resonate in a second frequency band higher than the first frequency band.

Preferably, a center frequency and an impedance bandwidth of the first frequency band are dependent upon dimensions of one of the first clearance and the first conducting arm and one of the second clearance and the second connecting arm. A center frequency and an impedance bandwidth of the second frequency band are dependent upon dimensions of the first, second and third clearances.

Preferably, the first frequency band ranges from 2412 MHz to 2462 MHz, and the second frequency band ranges from 5150 MHz to 5875 MHz.

Preferably, the multi-band antenna further comprises a coaxial transmission cable having a first signal terminal coupled electrically to the feed-in end, and a second signal terminal coupled electrically to the grounding end.

Preferably, the feed-in end and the grounding end are disposed on a common line to facilitate connection of the coaxial transmission cable to the feed-in end and the grounding end.

Preferably, the multi-band antenna further comprises a conductive foil connected to the loop conductor. The conductive coil is for connecting to a ground plane of a wireless device so as to increase a ground area of the multi-band antenna.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
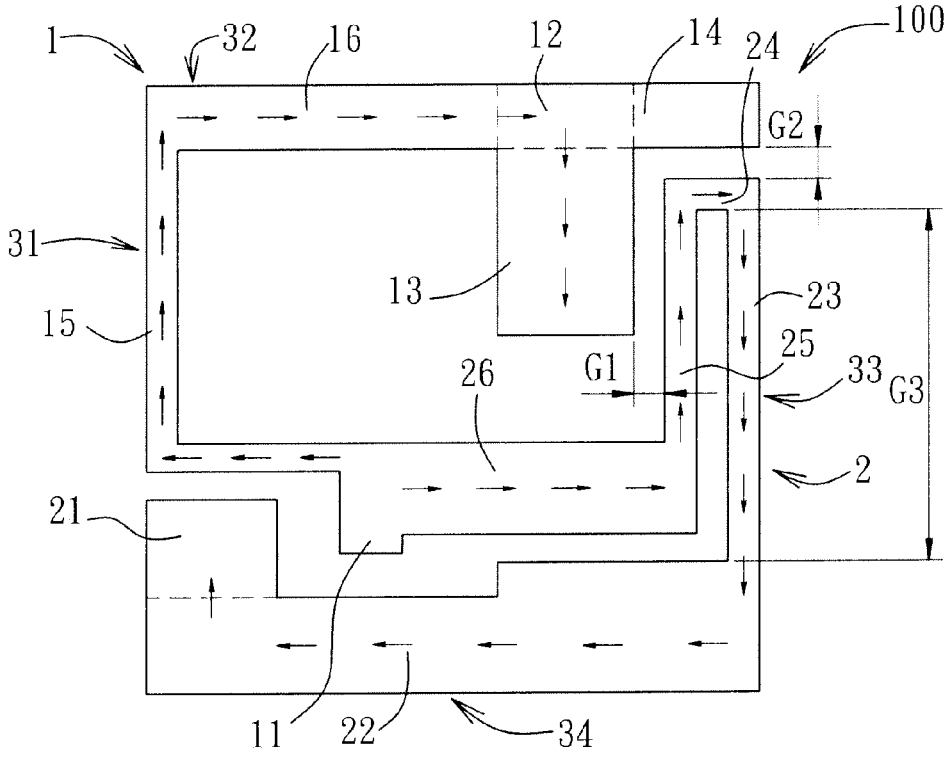
FIG. 1 is a schematic diagram illustrating a multi-band antenna of the preferred embodiment of the present invention.

Referring to FIG. 1, the preferred embodiment of a multi-band antenna 100 according to the present invention comprises a connecting conductor 1, a first conducting arm 13, a second conducting arm 14, and a loop conductor 2.

The connecting conductor 1 is a planar conducting wire, and has a feed-in end 11 and a connecting end 12 distal from each other.

The first conducting arm 13 and the second conducting arm 14 are planar conductors. Each of the first and second conducting arms 13, 14 has one end connected to the connecting end 12 of the connecting conductor 1. The first conducting arm 13 is substantially perpendicular to the second conducting arm 14.

The loop conductor 2, which is a planar conducting wire, has a first radiator section 25 adjacent and substantially parallel to the first conducting arm 13, and a second radiator section 24 adjacent and substantially parallel to the second conducting arm 14. The loop conductor 2 forms a substantially L-shaped gap with the first and second conducting arms 13, 14. The loop conductor 2 further has a grounding end 21 adjacent to the feed-in end 11, and extends from the grounding end 21 to the feed-in end 11.

In this embodiment, the dimensions of the multi-band antenna 100 are controlled to be within 10 mm (length)×10 mm (width)×0.8 mm (thickness). Therefore, the connecting conductor 1 includes a first radiator portion 15 that extends from the feed-in end 11 and that is at a first side 31 of a square, and a second radiator portion 16 that extends between the first radiator portion 15 and the connecting end 12. The second radiator portion 16 extends at a 90-degree angle from one end of the first radiator portion 15 opposite to the feed-in end 11 toward the connecting end 12. The second radiator portion 15 and the second conducting arm 14 are disposed at a second side 32 of the square adjacent to the first side 31. Moreover, the first conducting arm 13 extends from the connecting end 12 toward the interior of the square.

The loop conductor 2 further has a third radiator section 26 that extends from the feed-in end 11. The first radiator section 25 extends at a 90-degree angle from one end of the third radiator section 26 opposite to the feed-in end 11. The second radiator section 24 extends at a 90-degree angle from one end of the first radiator section 25 opposite to the third radiator section 22. The loop conductor 2 further has a fourth radiator section 23 that extends at a 90-degree angle from one end of the second radiator 24 opposite to the first radiator section 25. The fourth radiator section 23 is disposed at a third side 33 of the square adjacent to the second side 32. The loop conductor 2 further has a fifth radiator section 22 that extends between the fourth radiator section 23 and the grounding end 21. The fifth radiator section 22 extends at a 90-degree angle from one end of the fourth radiator section 23 opposite to the second radiator section 24 toward the grounding end 21. The fifth radiator section 22 is disposed at a fourth side 34 of the square adjacent to the first side 31 and the third side 33.

The first conducting arm 13 and the first radiator section 25 cooperate to form a first clearance (G1) therebetween. The second conducting arm 14 and the second radiator section 24 cooperate to form a second clearance (G2) therebetween. The L-shaped gap is constituted by the first clearance (G1) and the second clearance (G2). It should be noted herein that the widths of the first clearance (G1) and the second clearance (G2) are not necessarily the same. Furthermore, the second radiator section 24 and the fifth radiator section 22 cooperate to form a third clearance (G3) therebetween.

Figure 2:
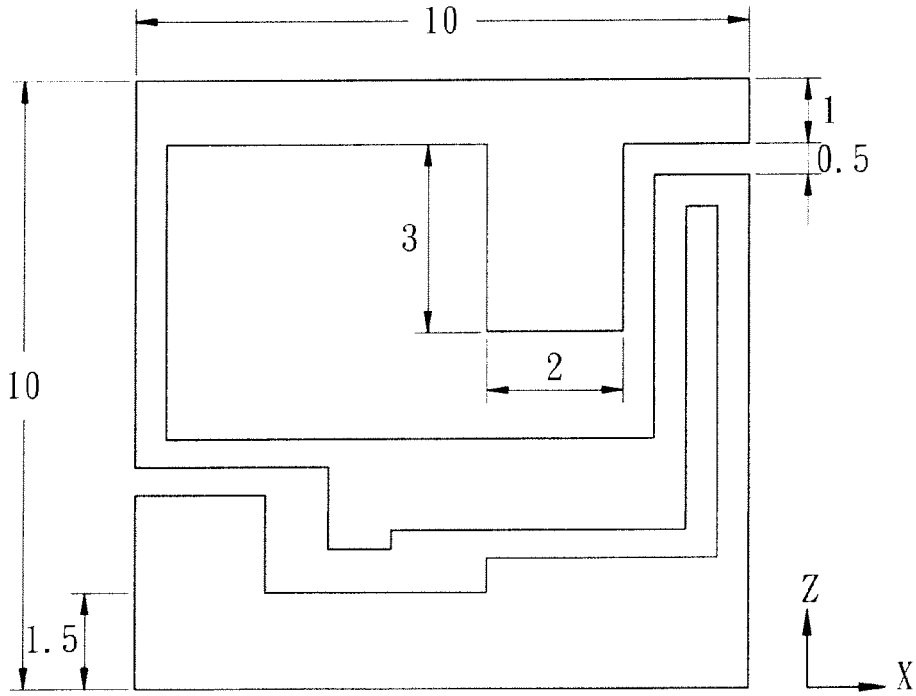
FIG. 2 is a schematic diagram illustrating dimensions of the multi-band antenna of the preferred embodiment.

FIG. 2 illustrates detailed dimensions (in mm) of the multi-band antenna 100 of this embodiment. With the dimensions shown in FIG. 2, the connecting conductor 1, the first conducting arm 13 and the second conducting arm 14 cooperate to resonate in a first frequency band ranging from 2412 MHz to 2462 MHz (802.11b/g), and the loop conductor 2 is configured to resonate in a second frequency band ranging from 5150 MHz to 5875 MHz (802.11a). Accordingly, the multi-band antenna 100 of this embodiment can operate in two frequency bands.

Furthermore, a center frequency and an impedance bandwidth of the first frequency band are dependent upon one of width of the first clearance (G1) and length of the first conducting arm 13, and one of width of the second clearance (G2) and length of the second conducting arm 14. A center frequency and an impedance bandwidth of the second frequency band are dependent upon dimensions (i.e., widths) of the first, second and third clearances (G1, G2, G3).

Figure 3:
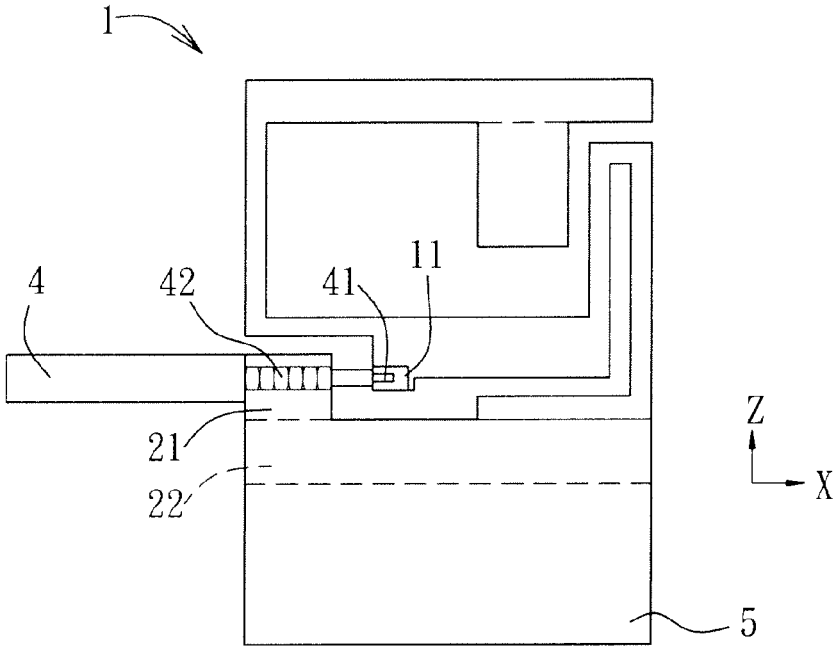
FIG. 3 is a schematic diagram illustrating coupling relations between a coaxial transmission cable and a feed-in end and a grounding end of a connecting conductor, and connecting relation between a conductive foil and a loop conductor.

Referring to FIG. 3, the multi-band antenna 100 of this embodiment further comprises a coaxial transmission cable 4 and a conductive foil 5. The coaxial transmission cable 4 has a first (positive) signal terminal 41 coupled electrically to the feed-in end 11, and a second (negative) signal terminal 42 coupled electrically to the grounding end 21. Preferably, the feed-in end 11 and the grounding end 21 are disposed on a common line to facilitate connection of the coaxial transmission cable 4 to the feed-in end 11 and the grounding end 21. The conductive foil 5 is connected to the loop conductor 2. More specifically, the conductive foil 5 is connected to the fourth radiator section 23 of the loop conductor 2 and covers a major portion of the fifth radiator section 22.

Figure 4:
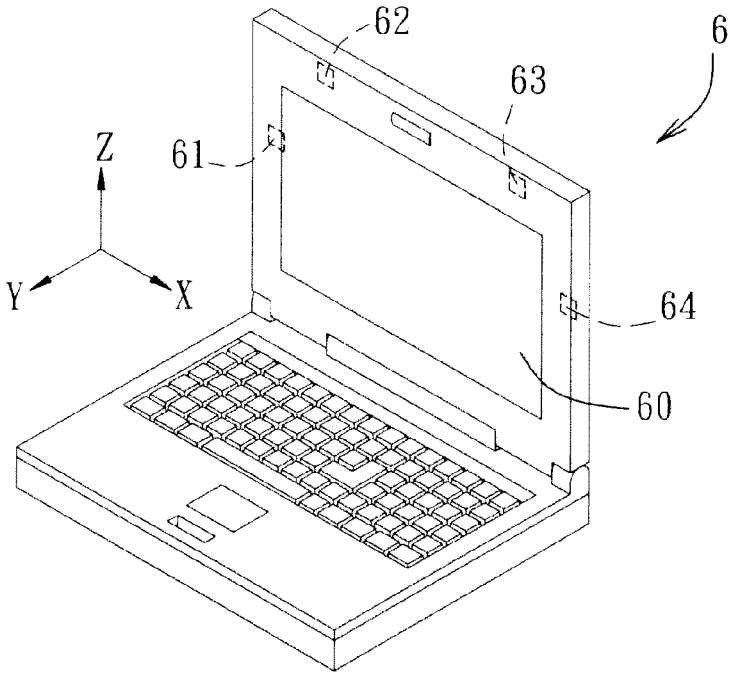
FIG. 4 is a perspective view showing a notebook computer installed with the multi-band antenna of the preferred embodiment.

Referring to FIG. 4, the multi-band antenna 100 of this embodiment may be disposed adjacent to a display panel 60 of a notebook computer 6. The positions denoted by reference numerals 61, 62, 63, 64 indicate preferred installation positions of the multi-band antenna 100. Moreover, when the multi-band antenna 100 is disposed in the notebook computer 6, the conductive foil 5 of the multi-band antenna 100 is connected to a ground plane (not shown) of the notebook computer 6 so as to increase a ground area of the multi-band antenna 100.

Figure 5:
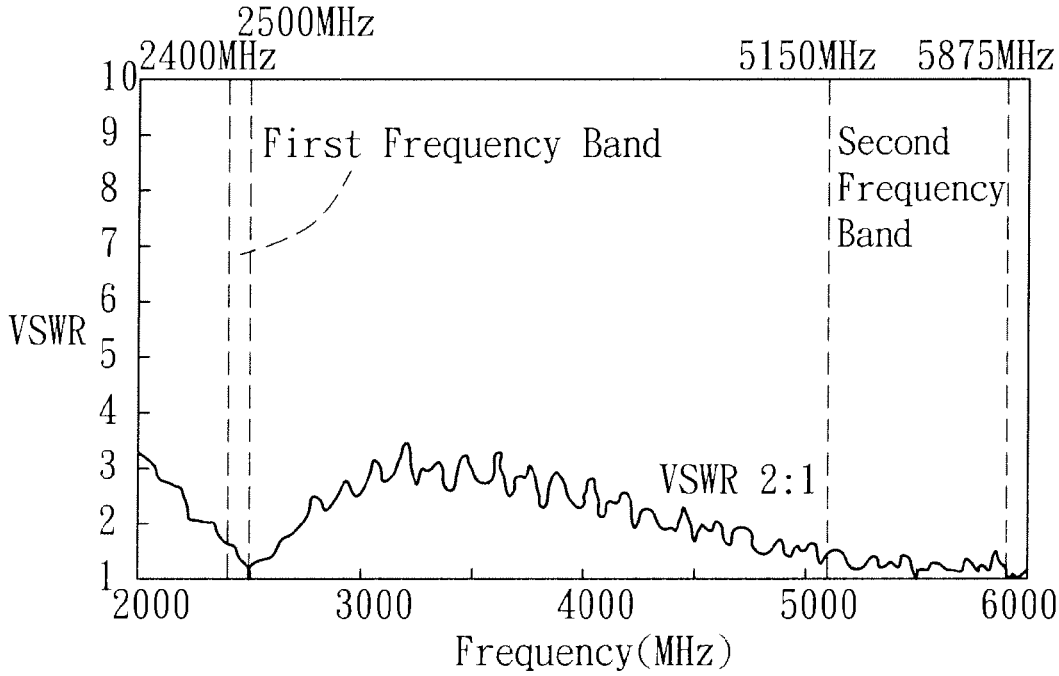
FIG. 5 is a Voltage Standing Wave Ratio (VSWR) plot showing VSWR values of the multi-band antenna of the preferred embodiment applied to a notebook computer.

FIG. 5 shows VSWR values of the multi-band antenna 100 of this embodiment applied to a notebook computer. It is apparent from this figure that the measured VSWR values of the multi-band antenna 100 at frequencies within the first frequency band and the second frequency band do not exceed 2.

Table 1 shows measured radiation efficiency of the multi-band antenna 100 of this embodiment applied to a notebook computer at frequencies within the first frequency band and the second frequency band. It can be noted from Table 1 that the overall radiation efficiency is >−4.4 dB (>36.7%).

TABLE 1

| Frequency (MHz) | Radiation Efficiency (dB) | Radiation Efficiency (%) |
|---|---|---|
| 2400 | −3.8 | 41.4 |
| 2450 | −3.4 | 45.4 |
| 2500 | −3.4 | 46.2 |
| 5150 | −4.1 | 38.8 |
| 5250 | −4.1 | 38.8 |
| 5350 | −4.2 | 37.7 |
| 5470 | −4.2 | 37.7 |

TABLE 1-continued

| Frequency (MHz) | Radiation Efficiency (dB) | Radiation Efficiency (%) |
|---|---|---|
| 5600 | −3.7 | 42.2 |
| 5725 | −4.4 | 36.7 |
| 5785 | −3.9 | 40.6 |
| 5875 | −3.9 | 40.5 |

Figure 6:
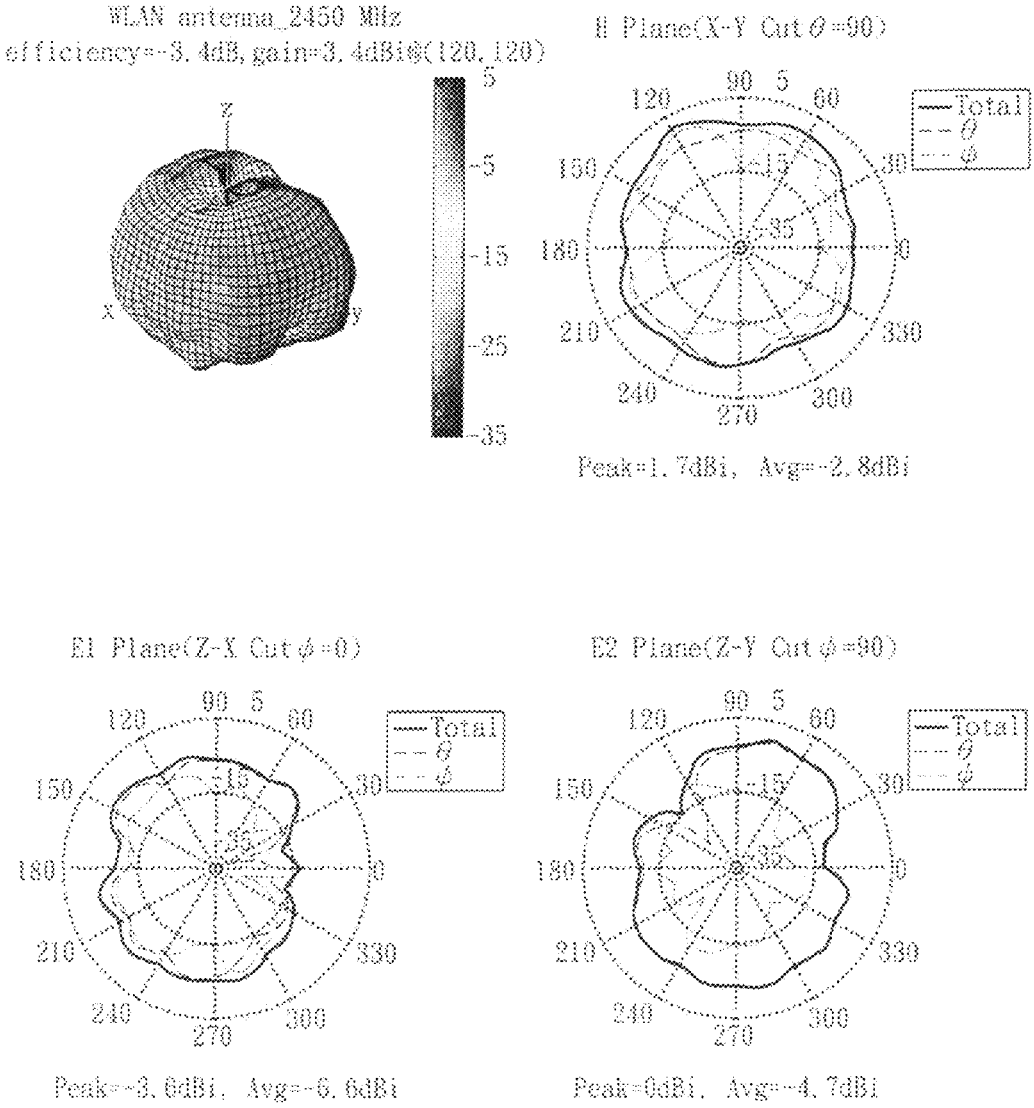
FIG. 6 illustrates radiation patterns of the multi-band antenna of the preferred embodiment operating at 2450 MHz.
Figure 7:
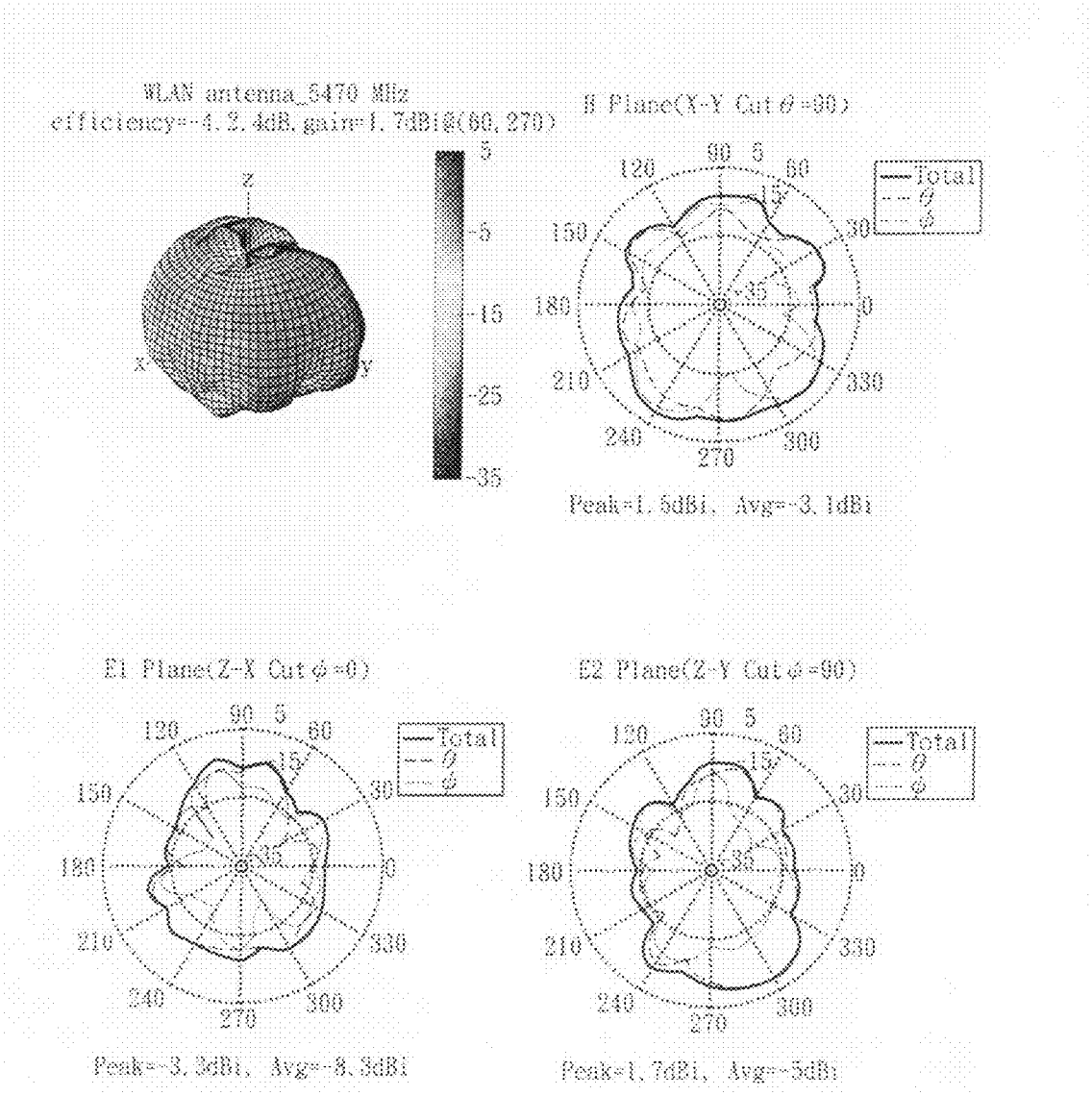
FIG. 7 illustrates radiation patterns of the multi-band antenna of the preferred embodiment operating at 5470 MHz.

FIGS. 6 and 7 illustrate radiation patterns of the multi-band antenna 100 of this embodiment. It can be noted from these figures that the radiation patterns of the multi-band antenna 100 are omnidirectional.

It has thus been shown that the multi-band antenna 100 according to this invention can operate at frequencies in the two frequency bands associated with the 802.11b/g and 802.11a communication protocols and has a relatively small size and simple structure. Furthermore, dimensions of the first conducting arm 13, the second conducting arm 14, the first clearance (G1), the second clearance (G2) and the third clearance (G3) can be controlled to set the center frequencies and impedance bandwidths of the first frequency band (802.11b/g frequency band) and the second frequency band (802.11a frequency band).

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A multi-band antenna comprising:

a connecting conductor having a feed-in end and a connecting end that are distal from each other;

a first conducting arm having one end connected to said connecting end of said connecting conductor;

a second conducting arm having one end connected to said connecting end of said connecting conductor, said second conducting arm being substantially perpendicular to said first conducting arm; and a loop conductor having a first radiator section adjacent and substantially parallel to said first conducting arm and a second radiator section adjacent and substantially parallel to said second conducting arm, said loop conductor forming a substantially L-shaped gap with said first and second conducting arms, said loop conductor further having a grounding end adjacent to said feed-in end and extending from said grounding end to said feed-in end.

2. The multi-band antenna as claimed in claim 1, wherein said connecting conductor includes a first radiator portion that extends from said feed-in end, and a second radiator portion that extends between said first radiator portion and said connecting end, said second radiator portion extending at an angle from one end of said first radiator portion opposite to said feed-in end toward said connecting end.

3. The multi-band antenna as claimed in claim 2, wherein said loop conductor further has a third radiator section that extends from said feed-in end, said first radiator section extending at an angle from one end of said third radiator section opposite to said feed-in end, said second radiator section extending at an angle from one end of said first radiator section opposite to said third radiator section, a fourth radiator section that extends at an angle from one end of said second radiator section opposite to said first radiator section, and a fifth radiator section that extends between said fourth radiator section and said grounding end, said fifth radiator section extending at an angle from one end of said fourth radiator section opposite to said second radiator section toward said grounding end.

4. The multi-band antenna as claimed in claim 3, wherein:

said first conducting arm and said first radiator section cooperate to form a first clearance therebetween;

said second conducting arm and said second radiator section cooperate to form a second clearance therebetween;

said L-shaped gap is constituted by said first and second clearances; and said second radiator section and said fifth radiator section cooperate to form a third clearance therebetween.

5. The multi-band antenna as claimed in claim 4, wherein said connecting conductor, said first conducting arm and said second conducting arm cooperate to resonate in a first frequency band, and said loop conductor is configured to resonate in a second frequency band higher than the first frequency band.

6. The multi-band antenna as claimed in claim 5, wherein:

a center frequency and an impedance bandwidth of the first frequency band are dependent upon dimensions of one of said first clearance and said first conducting arm and one of said second clearance and said second connecting arm; and a center frequency and an impedance bandwidth of the second frequency band are dependent upon dimensions of said first, second and third clearances.

7. The multi-band antenna as claimed in claim 5, wherein the first frequency band ranges from 2412 MHz to 2462 MHz, and the second frequency band ranges from 5150 MHz to 5875 MHz.

8. The multi-band antenna as claimed in claim 1, wherein said connecting conductor, said first conducting arm and said second conducting arm cooperate to resonate in a first frequency band, and said loop conductor is configured to resonate in a second frequency band higher than the first frequency band.

9. The multi-band antenna as claimed in claim 8, wherein the first frequency band ranges from 2412 MHz to 2462 MHz, and the second frequency band ranges from 5150 MHz to 5875 MHz.

10. The multi-band antenna as claimed in claim 1, wherein said feed-in end and said grounding end are disposed on a common line.

11. The multi-band antenna as claimed in claim 1, further comprising a coaxial transmission cable having a first signal terminal coupled electrically to said feed-in end, and a second signal terminal coupled electrically to said grounding end.

12. The multi-band antenna as claimed in claim 1, further comprising a conductive foil connected to said loop conductor.

* * * * *